US006244721B1

(12) United States Patent
Rodriguez et al.

(10) Patent No.: US 6,244,721 B1
(45) Date of Patent: Jun. 12, 2001

(54) ILLUMINATED HELMET DEVICE

(76) Inventors: Mark F. Rodriguez; Eugenia L. Rodriguez, both of P.O. Box 208, Bagdad, FL (US) 32530

( * ) Notice: Subject to any disclaimer, the term of this patent is extended or adjusted under 35 U.S.C. 154(b) by 0 days.

(21) Appl. No.: 08/998,103

(22) Filed: Dec. 24, 1997

(51) Int. Cl.[7] ..... F21V 33/00
(52) U.S. Cl. ..... 362/106; 362/105; 362/183
(58) Field of Search ..... 362/105, 106, 362/103, 183, 184

(56) References Cited

U.S. PATENT DOCUMENTS 5,416,675 * 5/1995 Debeaux ..... 362/106
5,508,900 4/1996 Norman ..... 362/106
5,559,680 * 9/1996 Tabanera ..... 362/106
5,564,128 * 10/1996 Richardson ..... 2/422
5,588,736 12/1996 Shea, Sr. ..... 362/106
5,743,621 * 4/1998 Mantha et al. ..... 362/105
5,758,947 * 6/1998 Glatt ..... 362/105

* cited by examiner

*Primary Examiner*—Laura K. Tso
(74) *Attorney, Agent, or Firm*—Carnes Cona Dixon

(57) ABSTRACT

An automatic illuminated helmet comprising at least one light source that is automatically activated by an activation device. The activation device is a pressure switch located within the helmet. In this design, as the switch contacts the user's head, the light source will be activated. Hence, when the helmet is worn, activation will occur. In an alternative embodiment, a photovoltaic panel is used to re-charge the power supply.

15 Claims, 6 Drawing Sheets

ILLUMINATED HELMET DEVICE

BACKGROUND OF THE INVENTION

1. Field of the Invention

The present invention relates generally to an illuminated helmet device and more particularly to an illuminated helmet device typically associated with cycling, sporting activities, and the like, used for protecting the head and face of an individual and inherently increasing the safety potential by offering a means of alerting surrounding persons to the user's presence. Such a lighted helmet is ideal for use by cyclists, sport enthusiasts, or the like, during times of darkness, such as the evening and during increment weather conditions.

2. Description of the Prior Art

Cycling, in-line skating, street hockey and the like are examples of sports which are progressively becoming more popular and widely experienced and enjoyed by the general public. Due to the ease of riding a bicycle or the thrill of skating, many individual participate, regardless of experience, age, athletic ability or manual dexterity. Cycling and other outdoor events, such as in-line skating, is not only enjoyable, but beneficial as well, by providing a means of aerobic exercise, which is notoriously known for leading a healthy life style.

As such, the sporting industry is encouraging the athlete to par-take in these beneficial activities by focusing on the comfort and safety associated with the particular sport. One means of safety is the use of a helmet, which, as a result, reduces injury to the head should an individual fall. Due to their known success, some states, such as Florida, include mandated regulations which require young cyclists to wear and utilize helmets while operating a conventional cycling device, such as a bicycle.

The high demand on adequate helmets has cause an increase in helmets including additional safety benefits. One of these benefits includes the use of a light source attached to the helmet device. Such a device is disclosed in U.S. Pat. No. 5,588,736 issued to Shea, Sr. In this patent there is disclosed a self-lighted safety helmet which includes an outer shell fabricated from a phosphorescent material. This phosphorescent material provides a helmet that will inherently glow without the presence of light. Unfortunately, such a helmet may glow, but the use of the phosphorescent material may add to the costs of the helmet and may even sacrifice its structural integrity.

Yet another device is disclosed in U.S. Pat. No. 5,508,900 issued to Norman. In this patent there is disclosed an illuminated helmet having a light source exteriorly mounted thereto. Activation of this light source occurs by the use of a switch, exteriorly located on the helmet. Though this helmet is efficient at providing an illuminating means, this helmet requires the user to activate the light source. For those who are absent-minded or forgetful, such as children, they may fail to adequately activate the helmet, and thus, defeat its intended purpose.

Accordingly, it is seen that none of these previous efforts provide the benefits intended with the present invention, such as providing an illuminated helmet device that automatically illuminates upon contact with the user. As evident by the prior art, it is seen that none of these prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention is an illuminated helmet device typically associated and used during sporting events, such as cycling, in-line skating, and the like. The illuminated helmet device of the present invention includes an automatic activation means for automatically activating the light when the helmet is worn.

The helmet device includes a foam layer and an outer hard shell. The foam layer is contoured and shaped like the user's head while the outer shell is secured to the foam layer. The foam layer and outer hard shell are designed and configured according to the safety standards as set forth by known safety organizations, such as the American National Standards Institute.

At least one conventional light source is secured to the exterior of the helmet. In one embodiment, the light source is activated upon securing the device to the user. In an alternative embodiment, the power used to activate the light source is re-chargeable by the use of solar energy. Both designs provide a unit that is safe and which guarantees the activation of the light source so as to provide a helmet that is useful and beneficial to the user. Activation of the light source will inherently increase the visibility of the user for alerting others of their presence.

Other components can be used with the helmet of the present invention. These added components will enhance the final product. Some of the features include, but are not limited to, the use of a reflective material secured to the shell, a strap for securing the device to the user, and air vents for permitting adequate air circulation.

Accordingly, it is the object of the present invention to provide for an illuminated helmet device that will overcome the deficiencies, shortcomings, and drawbacks of prior helmets and methods thereof.

Another object of the present invention is to provide an illuminated helmet device that will successfully provide an efficient alert means for warning other as to the presence of the user, by providing a unit which will automatically illuminate when worn or when there is an absence of light.

Still another object of the present invention, to be specifically enumerated herein, is to provide an illuminated helmet device in accordance with the preceding objects and which will conform to conventional forms of manufacture, be of simple construction and easy to use so as to provide a device that would be economically feasible, long lasting and relatively trouble free in operation.

Although there have been many inventions related to illuminated helmets, none of the inventions provide a means of automatic operation of an efficient light source for increasing the visibility of the user. Additionally, these inventions fail to be low cost and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
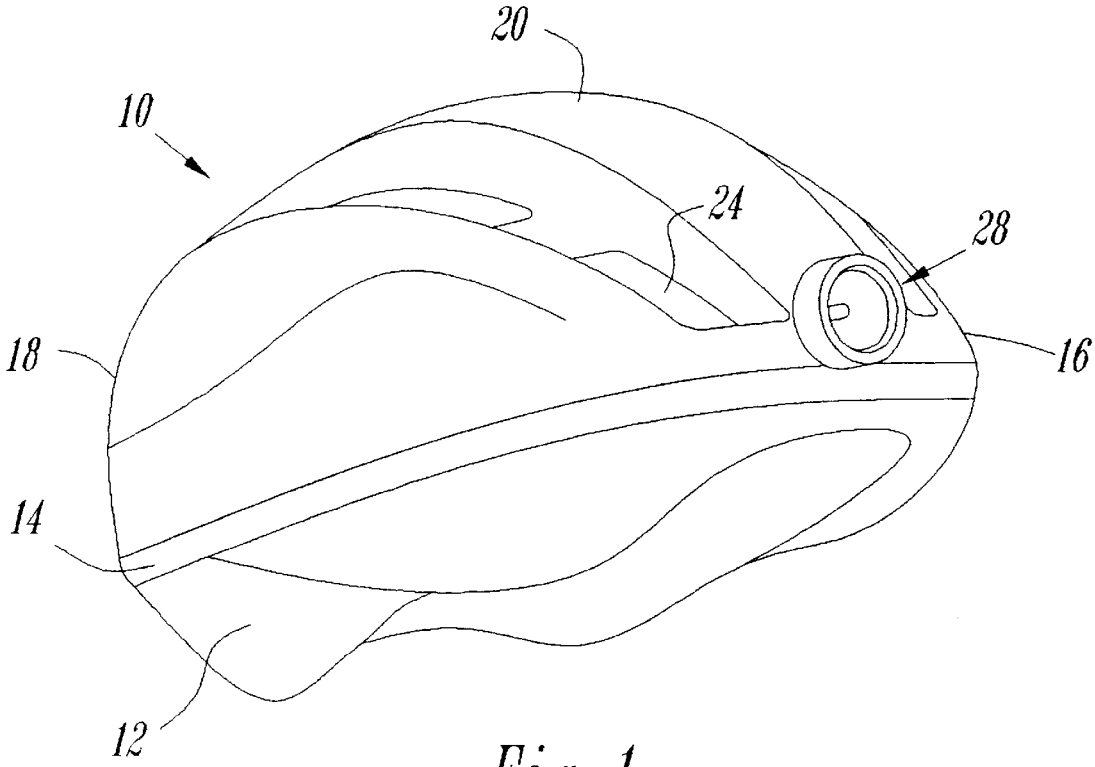
FIG. 1 is a perspective front view of the first. embodiment of the helmet device of the present invention.

With reference to drawings, in particular FIGS. 1–5 thereof, there is shown the first embodiment of the illuminated helmet device of the present invention.

As seen, the helmet device of the present invention, generally denoted by reference numeral 10, includes an inner foam layer 12 and an outer hard shell 14. This inner foam layer 12 is designed and configured to absorb energy from a potential impact, while the outer shell 14 will deflect sharp and obtrusive foreign objects.

This outer hard shell 14 is designed and configured to be removably secured to the foam layer 12. This will enable the user to alter and change the outer shell when desirable. The ability of changing the outer shell offers more versatility. Should damaged occur to the helmet, the damage part can be removed and discarded. Should a popular color or style be desirable, the outdated portion can be removed and discarded. This provides a unit that is not only safe but also economically reasonable.

The outer shell 14 is removably secured to the foam 12 layer by the use of any conventional attaching means, such as hook and loop material (VELCRO) or snaps. In this configuration, the attaching means will be located on the under surface of the hard shell and on the top surface of the foam layer. Thereby, providing for the engagement of the securing means to render the layers to be in a fixed position.

The inner foam layer 12 will contact the head of the user and provides for the interior of the unit 10. The outer hard shell 14 constitutes the exterior of the helmet 10. As seen in the drawings, particularly FIG. 1, the helmet 10, further includes a front 16, rear 18, and top surface 20. The front can further include a visor 22 (illustrated in FIG. 3) for providing a means of offering protection from the sun to the user. This visor 22 can be either permanently secured to the front of the helmet, or optionally, can be removably secured to the helmet via conventional attaching means, similar to what is used between the shell layer 14 and foam layer 12. Hence, and as seen in FIG. 3, the conventional attaching means can be snaps, or optionally can be hook and loop material, such as VELCRO.

Figure 2:
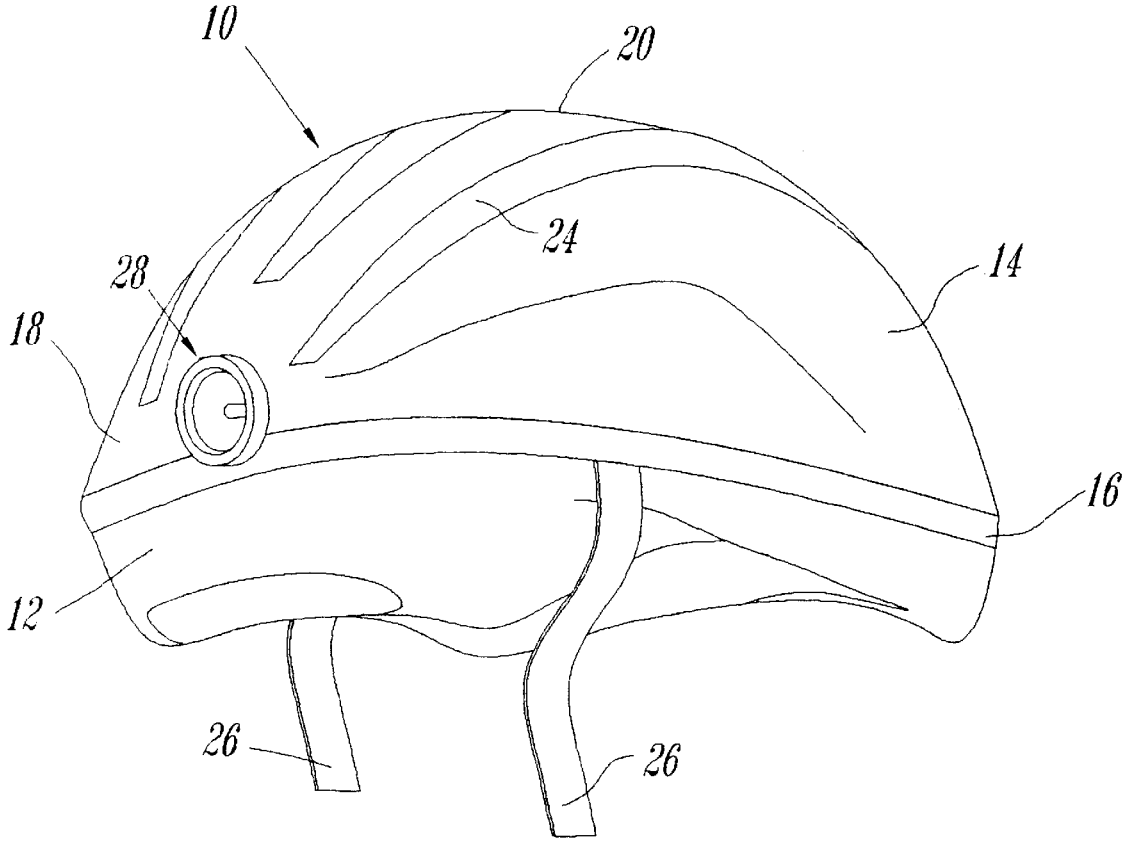
FIG. 2 is a perspective back view of the first embodiment of the helmet device of the present invention.
Figure 3:
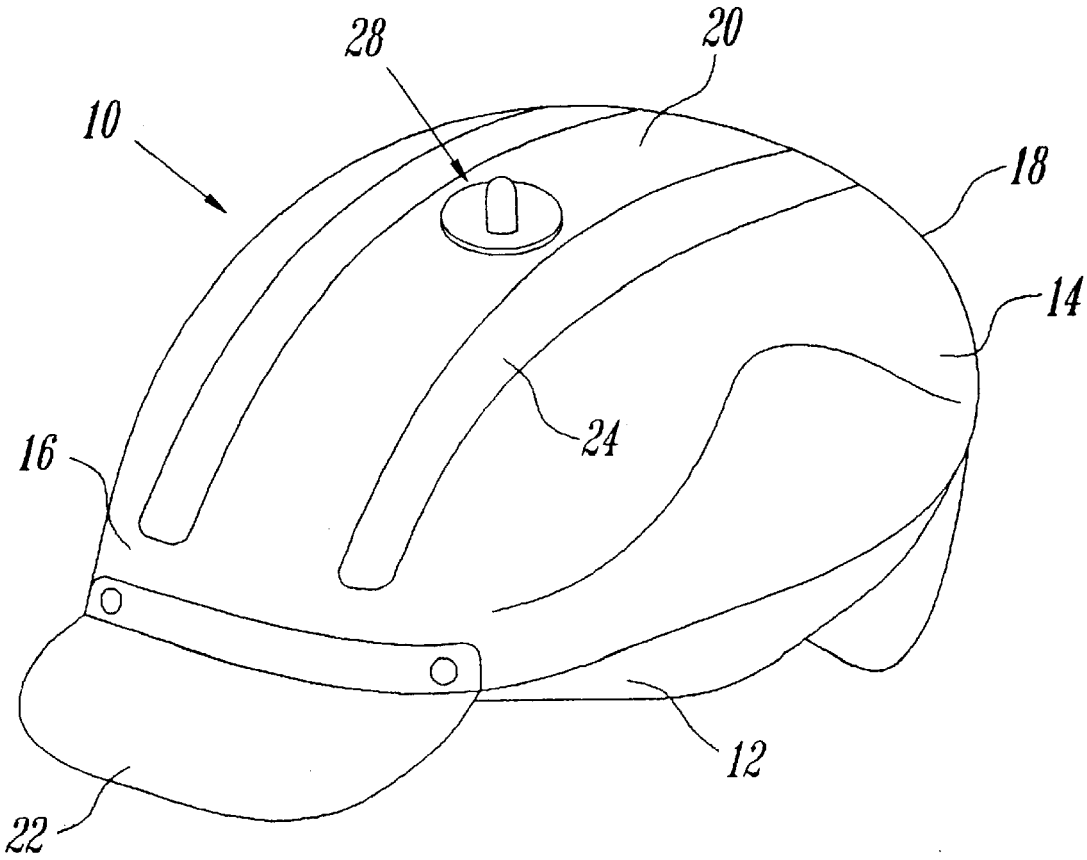
FIG. 3 is a perspective top view of the first embodiment of the helmet device of the present invention.

The helmet, as seen in FIGS. 1–3, has a substantially contoured shape dimensioned to fit at least partially over the head of the individual using the device 10. As seen in FIGS. 1–4, extending through the foam layer 12 and hard shell 14 are a plurality of apertures or air vents 24. These apertures or air vents 24 allow air to circular therethrough and will allow heat to escape from the interior of the unit. A strap 26 (illustrated in FIG. 2), can be used to secure the helmet to the user. As illustrated, the strap is attached to the exterior or hard shell 14 of the helmet 10.

An illumination means 28 is secured to the exterior of the helmet. This illumination means 28 can be secured either to the exterior of the helmet at either the front 16, as illustrated in FIG. 1, the rear 18, as illustrated in FIG. 2, the top 20, as illustrated in FIG. 3, or a combination thereof.

Figure 4:
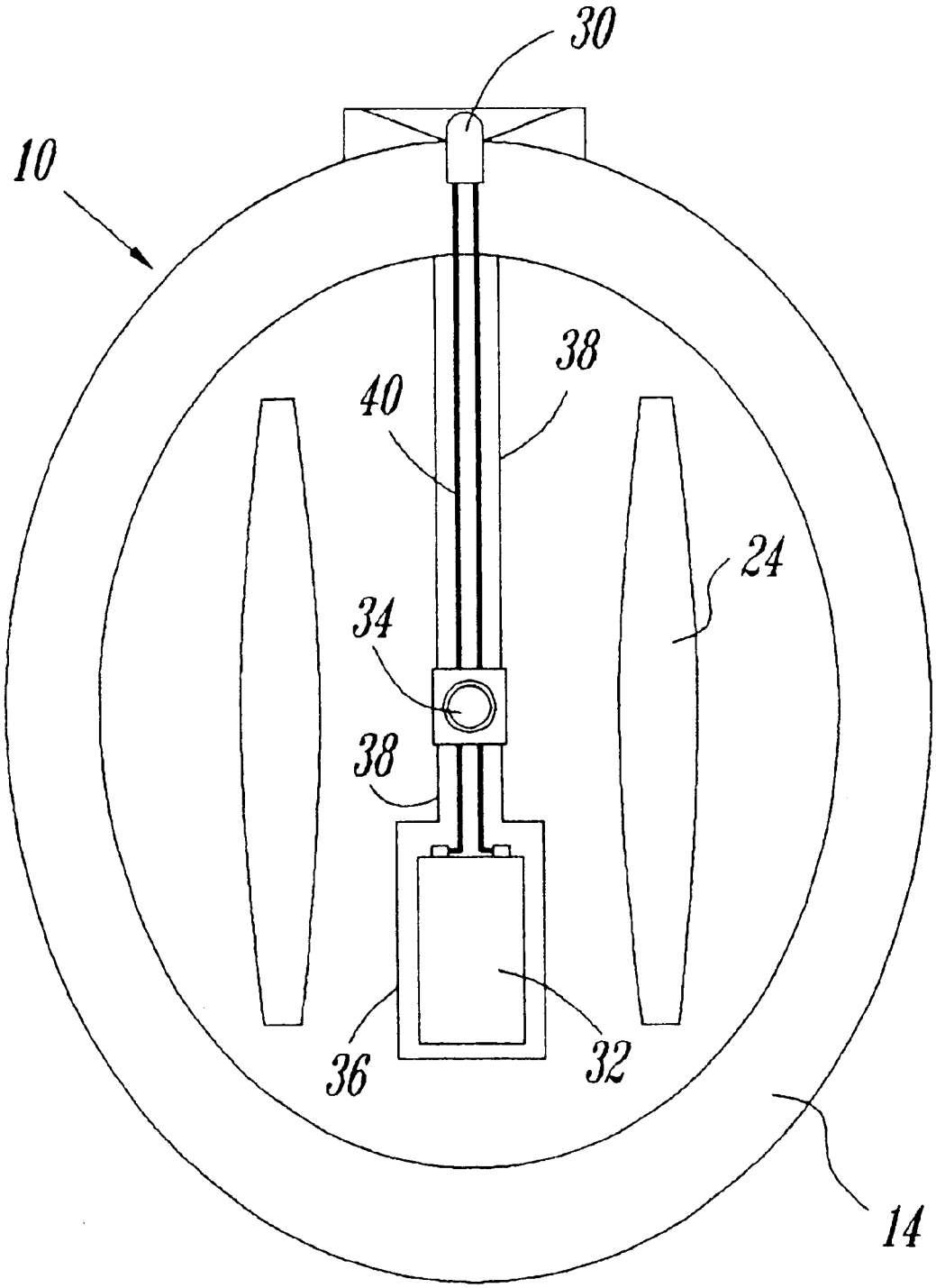
FIG. 4 is a bottom planar view of the interior portion of the first embodiment of the helmet device of the present invention.
Figure 5:
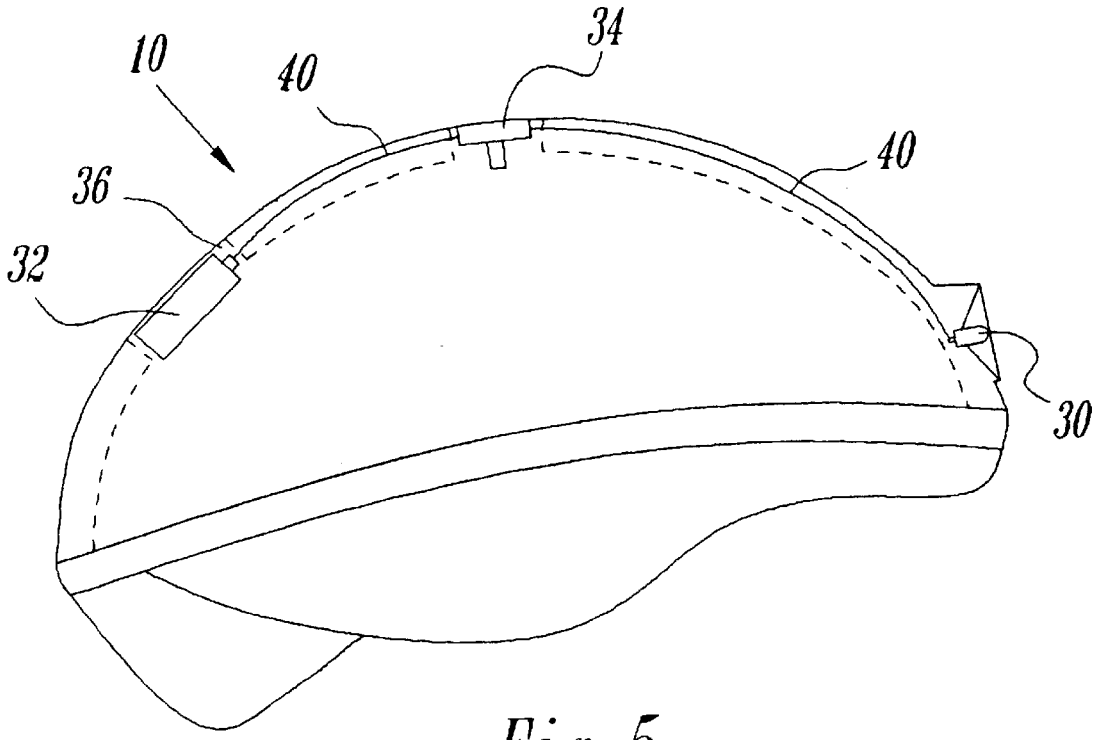
FIG. 5 is a partial cut-away side view of the first embodiment of the helmet device of the present invention.

The illumination means, as seen in FIGS. 4 and 5, comprises a light source 30 powered via a power source 32 and coupled to an activation means 34. The light source can be any conventional form, such as a continuous illumination device, an incandescent direct current light bulb (as illustrated in FIGS. 1–5), at least one LED (as illustrated in FIG. 6), or alternatively may comprise at least one flashing light source, such as a conventional flashing strobe light.

To accommodate the power source 32, a cavity 36, illustrated in FIGS. 4 and 5, is located within the foam layer 12. This cavity 36 will frictionally receive, engage and maintain the power source, thereby providing the power source to snap into place within the groove. Located within the top surface of the foam layer is a channel 38. These channels 38 will receive wiring 40 for allowing the power supply to be coupled to the activation means and the activation means to be coupled to the illumination means. When the hard shell 14 is secured to the foam layer, the channels 38 are not visible.

For activating and energizing the light source an activation means 34 is utilize. The activation means comprises a pressure switch located within the interior of the foam layer and, as seen, extends downwardly and into the interior of the helmet. Activation occurs upon contact with the user. When the user attaches the helmet 10 to their head, their head will contact the pressure switch and cause it to be depressed. This depression will provide for the switch to close and allow power to travel from the power supply 32 to the light source 30 by way of the wiring located within the channels 38. Accordingly, upon securing the helmet to the user, the light means is activated.

Figure 6:
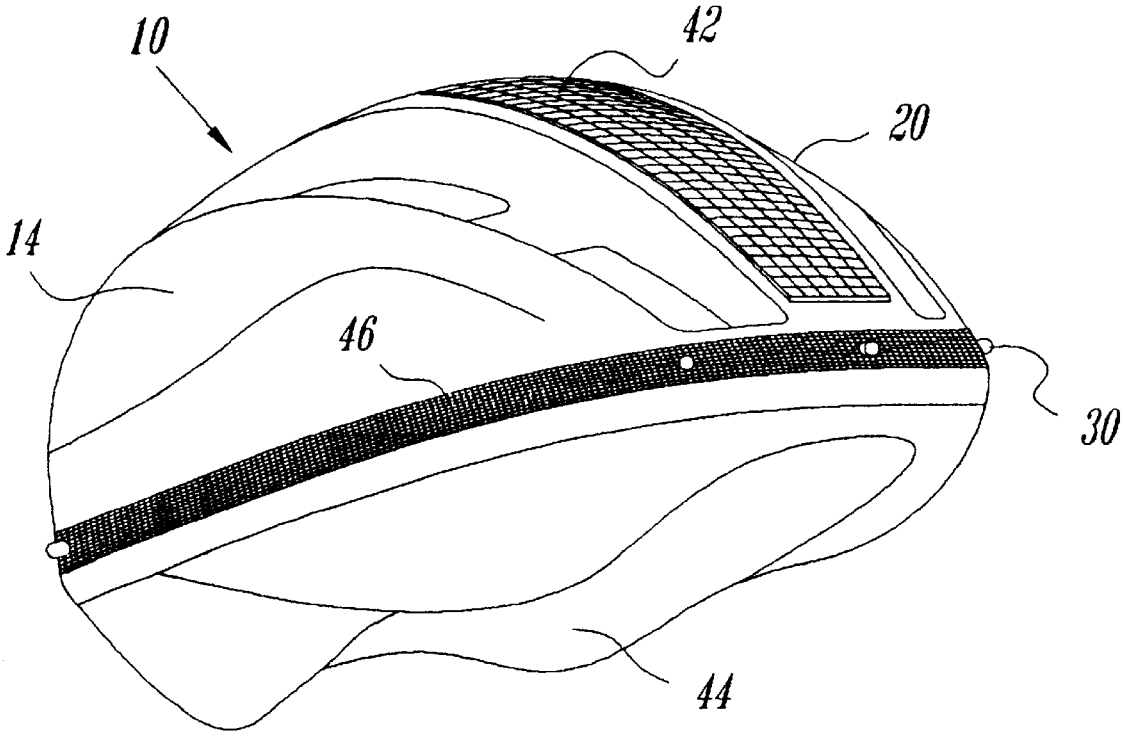
FIG. 6 is a front perspective view of the second embodiment of the helmet device of the present invention.

Alternatively, and as illustrated in FIG. 6, the activation means can be altered to provide for an energy efficient means for activating the light source. As seen in this drawing, the activation of the light source is control solarly. This will allow for the light source to be activated when the absence of light is detected. Thereby, allowing for the light source to operate automatically. Optionally, this embodiment can also be used for re-charging the battery when the device is not in use and when in the presence of light.

For rendering such an embodiment the helmet 10 includes a conventional photovoltaic panel 42 secured to the top surface 20 of the hard shell 14. This is an ideal location for enabling the photovoltaic panel 42 to absorb energy, such as sunlight. This photovoltaic panel is conventional and known in the electrical industry.

In this present invention, the photovoltaic panel 42 is electrically coupled between the power source 32, shown in FIGS. 4 and 5 and the pressure switch 34, shown in FIGS. 4 and 5. This position will provide for the photovoltaic panel to continuously charge the battery when the unit is not in use and when the unit is in the presence of light.

In an alternative position, the power source can be eliminated and the photovoltaic panel can be used to energize and power the light source.

Both configurations described for FIG. 6 are energy efficient and are deemed to utilize solar power for adequately charging the light source.

In the embodiments described above, in particular the embodiments illustrated in FIGS. 1–6, each can include additional elements for enhancing the final product. As shown in FIGS. 1–6, the helmets can include temple guards 44 for further protection for the user. Reflective tape 46 can be included for enhancing visibility. In addition the lights can be any size, shape or color. For example lights located on the front can be yellow while lights located at the rear can be red.

In addition, any number of light sources and any combination of light sources can be used with the present invention. For example, the use of a light source on the front and LED on the rear will provide a helmet that enhances visibility for the rider while still offer visibility to those in proximity of the user.

The helmet of the present invention is designed and configured with safety in mind. This system will automatically operate a light source for further enhancing the present invention.

While the invention has been particularly shown and described with reference to an embodiment thereof, it will be understood by those skilled in the art that various changes in form and detail may be made without departing from the spirit and scope of the invention.

We claim:

1. A safety helmet comprising:

a helmet body having an outer shell member;

at least one light source is secured to said outer shell member;

an automatic activation means for automatically activating said light source when worn; and said light source is powered using a photovoltaic panel secured exteriorly to said outer shell.

2. A safety helmet as in claim 1 wherein said automatic activation means includes a pressure switch interiorly located in and extend downward from said helmet, and said activation switch depresses, causing activation of said at least one light source, when worn.

3. A safety helmet as in claim 1 wherein said helmet body includes a foam layer and said outer shell is secured to said foam layer.

4. A safety helmet as in claim 3 wherein said outer shell is removably secured to said foam layer via a securing means.

5. A safety helmet as in claim 1 wherein a visor extends frontwardly from said outer shell.

6. A safety helmet as in claim 5 wherein said visor is removably secured to said outer shell.

7. A safety helmet as in claim 1 wherein a photovoltaic panel is exteriorly secured to said outer shell, said photovoltaic panel is electrically coupled between said at least one light source and said batteries, and said photovoltaic panel will recharge said battery when not in use.

8. A safety helmet as in claim 1 wherein air vents extend through said body and shell member.

9. A safety helmet as in claim 1 wherein said helmet body and said outer shell member being substantially contoured shaped and dimensioned to fit at least partially over a user's head when worn.

10. A safety helmet as in claim 9 wherein said helmet body includes temple guards.

11. A safety helmet as in claim 1 wherein said hard shell further includes reflective material for further protection.

12. A safety helmet as in claim 1 wherein said helmet body includes a front, rear and top, and one light source is located at said front.

13. A safety helmet as in claim 1 wherein said helmet body includes a front, rear and top, and one light source is located at said top.

14. A safety helmet as in claim 1 wherein said helmet body includes a front, rear and top and one light source is located at said rear.

15. A safety helmet as in claim 1 where said outer shell includes straps for securing said helmet body to a user.

* * * * *